US009352550B2

(12) United States Patent
Zhang

(10) Patent No.: US 9,352,550 B2
(45) Date of Patent: May 31, 2016

(54) RECORDING APPARATUS

(71) Applicant: SEIKO EPSON CORPORATION, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/489,061

(22) Filed: Sep. 17, 2014

(65) Prior Publication Data

US 2015/0138291 A1 May 21, 2015

(30) Foreign Application Priority Data

Nov. 20, 2013 (JP) ..... 2013-239667

(51) Int. Cl.

| | |
|---|---|
| ***B41J 2/01*** | (2006.01) |
| ***B41F 21/00*** | (2006.01) |
| ***B41J 3/407*** | (2006.01) |
| ***B41J 3/00*** | (2006.01) |
| *B41J 25/304* | (2006.01) |

(52) U.S. Cl.

CPC . *B41F 21/00* (2013.01); *B41J 3/00* (2013.01); *B41J 3/4073* (2013.01); *B41J 25/304* (2013.01)

(58) Field of Classification Search

CPC ..... B41J 3/4073

See application file for complete search history.

(56) References Cited

U.S. PATENT DOCUMENTS

| | | | | |
|---|---|---|---|---|
| 6,135,654 | A * | 10/2000 | Jennel | 400/61 |
| 6,460,958 | B2 * | 10/2002 | Kubo et al. | 347/2 |
| 8,043,014 | B2 * | 10/2011 | Tamaki et al. | 400/29 |
| 2010/0091054 | A1 * | 4/2010 | Vesanto et al. | 347/9 |
| 2010/0192517 | A1 * | 8/2010 | Schach | 53/411 |
| 2010/0302304 | A1 * | 12/2010 | Bauer | 347/20 |

FOREIGN PATENT DOCUMENTS

EP 1701222 A2 * 9/2006

* cited by examiner

*Primary Examiner* — Shelby Fidler
*Assistant Examiner* — Tracey McMillion
(74) *Attorney, Agent, or Firm* — Workman Nydegger

(57) ABSTRACT

By providing a rotating body which supports three-dimensional recording media on a support surface in a direction which intersects with a gravity direction and which has a rotating shaft in the direction which intersects with the support surface, and a recording head which carries out recording onto recording media by discharging ink in a direction which intersects with the rotating shaft, recording is carried out with high quality with respect to the recording media while firmly supporting the three-dimensional recording media.

6 Claims, 3 Drawing Sheets

RECORDING APPARATUS

BACKGROUND

1. Technical Field

The present invention relates to a recording apparatus.

2. Related Art

In the related art, recording apparatuses which carry out recording onto recording media by discharging ink are used. Among these, recording apparatuses which support recording media on an arcing surface of a rotating drum and carry out recording by discharging ink onto the recording media are used as disclosed in, for example, JP-A-2005-96203 and JP-A-2002-355952.

In addition, there has been a demand in recent years for recording with high quality by discharging ink with respect to three-dimensional recording media.

In a case where recording is carried out by discharging ink with respect to three-dimensional recording media, it is necessary to firmly support the recording media; however, there are difficulties in firmly supporting the recording media in the methods for supporting the recording media in the recording apparatuses of the related art because the recording media are three-dimensional.

For example, in the recording apparatus as disclosed in JP-A-2005-96203 and JP-A-2002-355952 which supports recording media on an arcing surface of a rotating drum, there are difficulties in firmly supporting the three-dimensional recording media.

On the other hand, as described above, there is also a demand for recording with high quality with respect to three-dimensional recording media.

SUMMARY

An advantage of some aspects of the invention is to firmly support three-dimensional recording media and carry out recording with high quality with respect to the recording media.

According to an aspect of the invention, there is provided a recording apparatus including a rotating body which supports a three-dimensional recording medium on a support surface in a direction which intersects with a gravity direction and has a rotating shaft in a direction which intersects with the support surface, and a recording head which carries out recording onto the recording medium by discharging ink in a direction which intersects with the rotating shaft.

Here, the "direction which intersects with" has a meaning which also includes directions other than an orthogonal direction and which deviate from the orthogonal direction.

According to the aspect, the rotating body which supports the three-dimensional recording media supports the recording media on a support surface in a direction which intersects with the gravity direction. For this reason, by mounting and supporting the recording media on the support surface, it is possible to support the recording media in a stable manner with the support surface as a reference with a simple configuration.

In addition, in the configuration according to the aspect, recording is carried out onto the recording media by discharging ink in a direction which intersects with the rotating shaft with respect to the recording media which are supported on the rotating body. In a case where the recording head is arranged in the direction along the rotating shaft, for example, so as to oppose the support surface, to discharge the ink, there are places in the recording regions on the recording media which are near the rotating shaft and places which are far therefrom; however, since the peripheral speed is different according to the distance from the rotating shaft, it is necessary to control the discharge timing and there is a possibility that unevenness will occur due to shifting of the ink during landing. In contrast to this, with the aspect, it is possible to set the distance from the recording region of the recording media and the rotating shaft to be substantially constant and it is possible to carry out recording with high quality.

In the recording apparatus of the invention of the aspect described above, the recording media may be containers which are able to change shape.

In a case where the recording media are containers which are able to change shape, it is particularly difficult to firmly support the recording media. However, according to the aspect, the recording media are supported on a support surface in a direction which intersects with the gravity direction. For this reason, even when the recording media are containers which are able to change shape, it is possible to support the recording media in a stable manner with the support surface as a reference. In addition, in a case where desired contents are filled into the interiors of the recording media, it is possible to suppress changes in the shape of the containers, and it is possible to support the recording media in a more stable manner by mounting and supporting the recording media on the support surface.

In the recording apparatus of the invention of the aspect described above, the rotating body may be able to support a plurality of the recording media on the support surface.

According to the aspect, the rotating body is able to support a plurality of recording media on the support surface. For this reason, it is possible to shorten the time for carrying out recording on the plurality of recording media and to improve the use efficiency of the recording head.

The recording apparatus of the invention of the aspect described above may further include a plurality of the rotating bodies, in which the recording head is common to the plurality of rotating bodies.

According to the aspect, since a plurality of the rotating bodies are provided, it is possible to shorten the time for carrying out recording onto a plurality of recording media.

In addition, according to the aspect, since the recording head is common to a plurality of the rotating bodies, it is possible to reduce costs and it is possible to increase the use efficiency of the recording head.

The recording apparatus of the invention of the aspect described above may further include a plurality of the recording heads and it is possible for recording media which are supported on each of the rotating bodies to oppose each of the recording heads.

According to the aspect, it is possible to perform recording with the recording media which are supported on each of the rotating bodies opposing each of the recording heads. For this reason, it is possible to improve the recording efficiency and it is possible to shorten the time for carrying out recording.

The recording apparatus of the invention of the aspect described above may further include a rotation support section which supports the plurality of recording heads, in which, by rotating the rotation support section, it is possible to change a combination of the rotating body on which the recording media are supported and the recording head.

According to the aspect, by rotating the rotation support section, it is possible to change the recording head which discharges ink onto the recording media which are supported on the rotating body and it is possible to discharge ink from a plurality of heads. For this reason, in a case where different inks are discharged for each head, it is possible to carry out recording using various inks with respect to the recording media. In addition, in a case where the same ink is discharged for each head, even when there are variations in the ink discharge amount for each head, errors are diffused and discharge unevenness is reduced due to the discharging being carried out from the plurality of heads. Furthermore, in a case where the recording of a certain rotating body is in a paused state, it is possible to increase the utilization rate for each recording head by switching to a recording head which is used at another rotating body.

In the recording apparatus of the invention of the aspect described above, the rotating body may rotate in one direction and it is possible to discharge ink a plurality of times with respect to the same recording medium.

According to the aspect, it is possible to set the direction of movement relative to the recording head during recording of the recording media to one direction, it is possible to set the time from the discharging of the ink from the recording head until the landing of the ink onto the recording media to be constant when the distance between the recording head and the recording media is maintained to be constant, and it is possible to carry out recording with high quality. In addition, since it is possible to carry out the relative movement without acceleration and deceleration at the time of movement relative to the recording head during recording onto the recording media, it is possible to carry out recording with high quality. In addition, since it is possible to carry out recording by dividing the recording into a plurality of times at substantially fixed periods by rotating the rotating body, it is possible to carry out recording while securing the drying times for the ink which was discharged onto the recording media and it is possible to carry out recording with high quality. In addition, since it is possible to carry out recording by dividing the recording into a plurality of times by rotating the rotating body, it is possible to carry out recording by overlapping inks on the recording media and it is possible to carry out recording with high quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

FIG. 1 to FIG. 3C

Below, detailed description will be given of the recording apparatus according to Embodiment 1 of the invention with reference to the accompanying diagrams.

Figure 1:
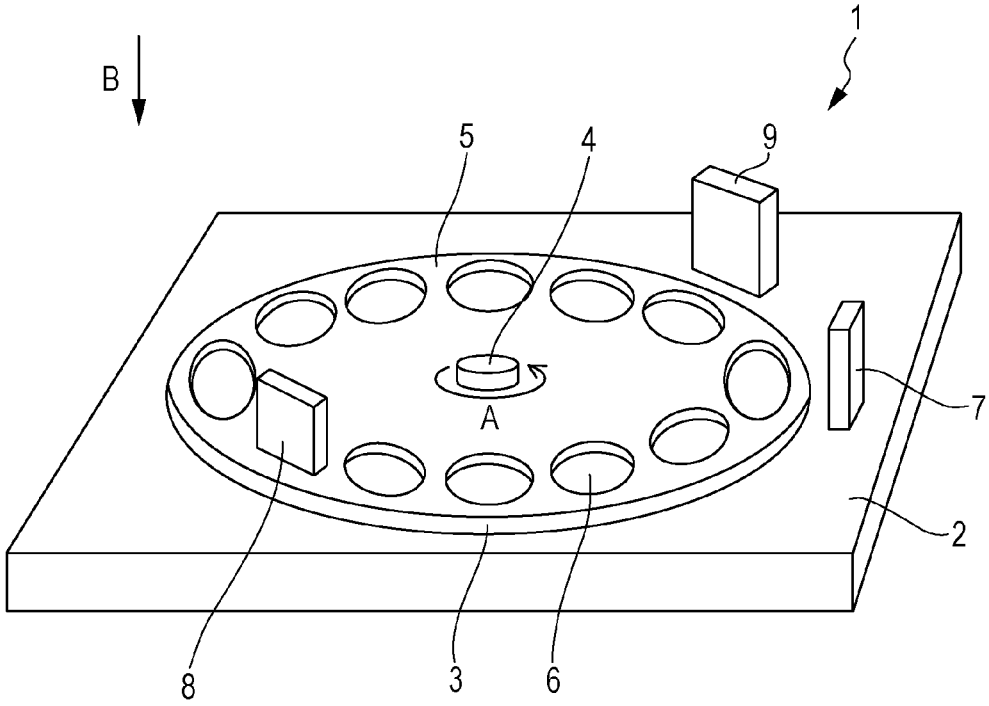
FIG. 1 is a schematic perspective diagram which represents a recording apparatus according to Embodiment 1 of the present invention.
Figure 2:
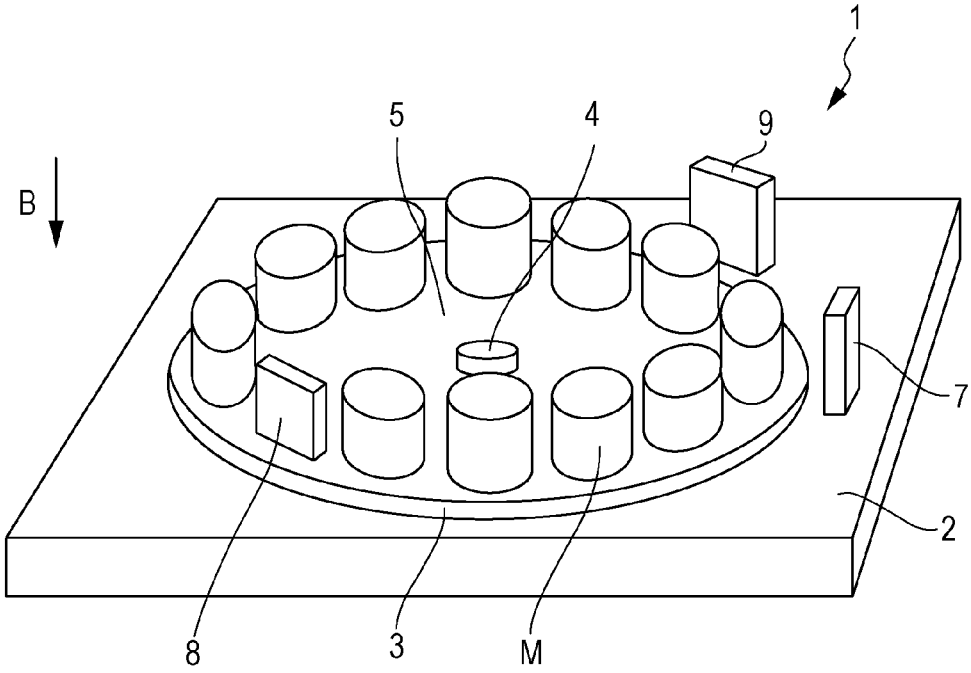
FIG. 2 is a schematic perspective diagram which represents the recording apparatus according to Embodiment 1 of the present invention.

FIG. 1 and FIG. 2 are schematic perspective diagrams which represent a recording apparatus 1 of the present embodiment. FIG. 1 is a diagram which represents a state where three-dimensional recording media M are not set in the recording apparatus 1. FIG. 2 is a diagram which represents a state where the three-dimensional recording media M are set in the recording apparatus 1.

The recording apparatus 1 of the present embodiment is provided with a base section 2, and a rotating body 3 which is supported on the base section 2 and which rotates in a rotation direction A with reference to a rotating shaft 4 with respect to the base section 2.

As represented in FIG. 1, the rotating body 3 is provided with a plurality of support sections 6 on a support surface 5 which supports the three-dimensional recording media M. The recording apparatus 1 of the present embodiment is configured to support the recording media M by the recording media M being inserted with respect to a support section 6 in the direction B; however, the recording apparatus 1 is not limited to this configuration. For example, the recording apparatus 1 may be configured to be further provided with an assistance member or the like which assists in the support of the recording media M. In addition, the support section 6 may be configured to be upright with respect to the support surface 5 and the recording media M may be placed from the rotating shaft side with respect to the support section 6. In such a case, due to the centrifugal force during rotating, it is easy to hold the recording media M on the support section 6.

Here, for the recording apparatus 1 of the present embodiment, the support surface 5 is provided in the horizontal direction and the direction in which the rotating shaft 4 extends is the vertical direction; however, without being limited to this configuration, the support surface 5 may be shifted from the horizontal direction and the direction in which the rotating shaft 4 extends may be shifted from the vertical direction.

FIG. 2 is a diagram which represents a state where the three-dimensional recording media M are set in the recording apparatus 1; however, a recording head 7 is provided on the base section 2 at a position which is able to oppose the recording media M which are set on the rotating body 3. The recording head 7 carries out recording onto the recording media M by discharging ink in a direction which intersects with the rotating shaft 4 when the recording media M are moved to the opposing position. The recording head 7 of the present embodiment has a configuration which carries out recording onto the recording media M by discharging ink in the horizontal direction; however, the direction in which the ink is discharged may be shifted from the horizontal direction according to the inclination of the support surface 5.

When the above description is expressed another way, the recording apparatus 1 of the present embodiment is provided with the rotating body 3 which supports the three-dimensional recording media M on the support surface 5 in the direction which intersects with respect to the gravity direction B, and which has the rotating shaft 4 in the direction B which intersects with the support surface 5. In addition, the base section 2 which supports the rotating body 3 is provided. In addition, the recording head 7 which is provided on the base section 2 and which records onto the recording media M by discharging ink in a direction which intersects with the rotating shaft 4 is provided.

Here, the recording apparatus 1 of the present embodiment is provided with the recording head 7 on the base section 2 which supports the rotating body 3; however, the rotating body 3 and the recording head 7 need not be provided on the same base section. By providing each of the above on different base sections, in a case where the rotating body 3 generates vibration, it is difficult to transmit the vibration which is generated to the recording head 7 and it is possible to suppress the influence on the recording quality.

Here, the "direction which intersects with" has a meaning which includes directions other than an orthogonal direction and which deviate from the orthogonal direction.

That is, since the rotating body 3 which supports the recording media M is configured to support the recording media M on the support surface 5 in the direction which intersects with respect to the gravity direction B, it is possible to support the recording media M in a stable manner with reference to the support surface 5 with a simple configuration by mounting and supporting the recording media M on the support surface 5.

In addition, since the invention is configured to carry out recording onto the recording media by discharging ink from the recording head 7 in a direction which intersects with the rotating shaft 4 with respect to the recording media M which are supported on the rotating body 3, it is possible to set the movement relative to the recording head 7 during recording onto the recording media M to one direction which is the rotation direction A, it is possible to maintain a constant time from the discharging of the ink from the recording head 7 up to the landing of the ink onto the recording media M when the distance between the recording head 7 and the recording media M is preserved to be constant, and it is possible to carry out recording with high quality.

In addition, since it is possible to carry out the relative movement without acceleration and deceleration at the time of movement relative to the recording head 7 during recording onto the recording media M, it is possible to carry out recording with high quality.

In addition, since it is possible to carry out recording by dividing the recording into a plurality of times at substantially fixed periods, such as recording at a first rotation and recording at a second rotation, by rotating the rotating body 3 in the rotation direction A, it is possible to carry out recording while securing the drying times for the ink which was discharged onto the recording media M and it is possible to carry out recording with high quality.

In addition, since it is possible to carry out recording by dividing the recording into a plurality of times by rotating the rotating body 3 in the rotation direction A, it is possible to carry out recording by overlapping inks on the recording media M and it is possible to carry out recording with high quality.

In addition, a maintenance box 8 is provided at a position, which is able to oppose the recording head 7, on the rotating body 3 of the recording apparatus 1 of the present embodiment. For example, when the maintenance box 8 is brought to a position which opposes the recording head 7 by rotating the rotating body 3 in the rotation direction A, it is possible to perform flushing by discharging ink from the recording head 7 into the maintenance box 8.

Here, a configuration which performs wiping, cleaning, or the like of the recording head 7 may be added with respect to the recording apparatus 1 of the present embodiment.

In addition, a drying unit 9 is provided at a position, which is able to oppose the recording media M, on the base section 2 of the recording apparatus 1 of the present embodiment. The drying unit 9 of the present embodiment has a configuration which is able to blow warm air with respect to the recording media M; however, without being limited to this configuration, the drying unit 9 may be a heater such as an infrared heater which heats the recording media M or the ink which is discharged onto the recording media M, a fan which blows a gas which is not warmed up with respect to the recording media M, or the like.

In addition, it is possible for the recording apparatus 1 of the present embodiment to use containers which are able to change shape as the recording media M.

In a case where containers which are able to change shape are used as the recording media M, it is particularly difficult to firmly support the recording media M. However, the recording apparatus 1 of the present embodiment supports the recording media M on the support surface 5 in the direction which intersects with respect to the gravity direction B. For this reason, even when the recording media M are containers which are able to change shape, it is possible to support the recording media in a stable manner with the support surface as a reference. In addition, in a case where desired contents are filled into the interiors of the recording media M, it is possible to suppress changes in the shape of the container, and it is possible to support the recording media M in a more stable manner by mounting and supporting the recording media M on the support surface 5.

Here, specific examples of the containers which are able to change shape include soft bottles made of polyethylene or polypropylene; however, the containers are not limited thereto.

In addition, as represented in FIG. 1 and FIG. 2, it is possible for the rotating body 3 of the recording apparatus 1 of the present embodiment to support a plurality of the recording media M on the support surface 5.

For this reason, the use efficiency of the recording head 7 is increased along with the shortening of the time for carrying out recording onto the plurality of recording media M.

By rotating the rotating body 3 which supports the recording media M once, it is possible for the recording apparatus 1 of the present embodiment to finish the recording onto the recording media M which are supported on the rotating body 3. On the other hand, by rotating the rotating body 3 which supports the recording media M a plurality of times, it is possible to perform the recording onto the recording media M which are supported on the rotating body 3 by dividing the recording into a plurality of times.

Next, description will be given of a case where the rotating body 3 which supports the recording media M is rotated a plurality of times and the recording of the recording media M which are supported on the rotating body 3 is performed by being divided into a plurality of times.

Here, in the following description, description will be given of a case where the rotating body 3 which supports the recording media M is rotated twice and recording of the recording media M which are supported by the rotating body 3 is performed by being divided into two times; however, the recording may be performed by dividing the recording into three times or more.

Figure 3A:
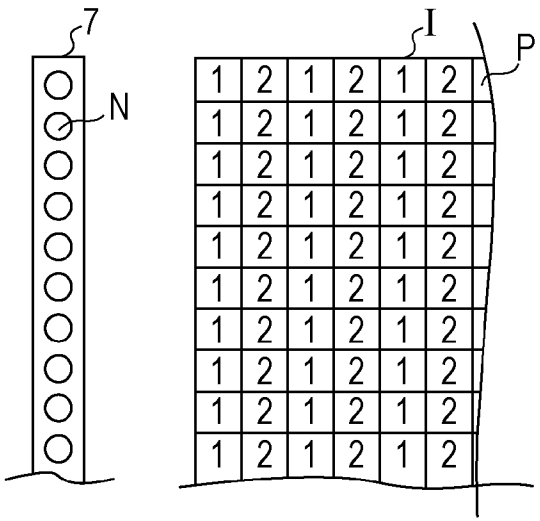
FIGS. 3A, 3B, and 3C are schematic diagrams which represent discharge positions of ink when recording onto recording media using the recording apparatus according to Embodiment 1 of the present invention.
Figure 3B:
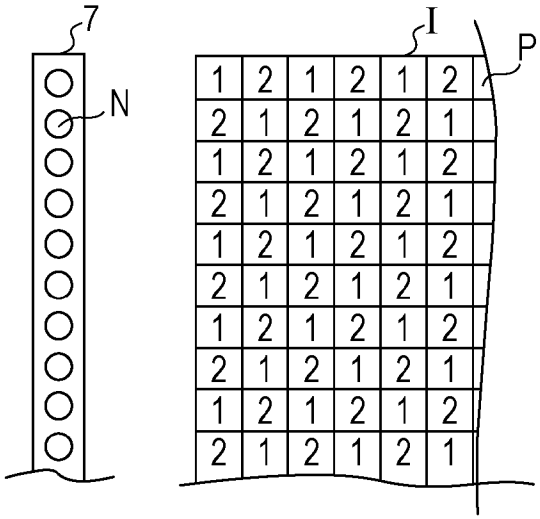
Figure 3C:
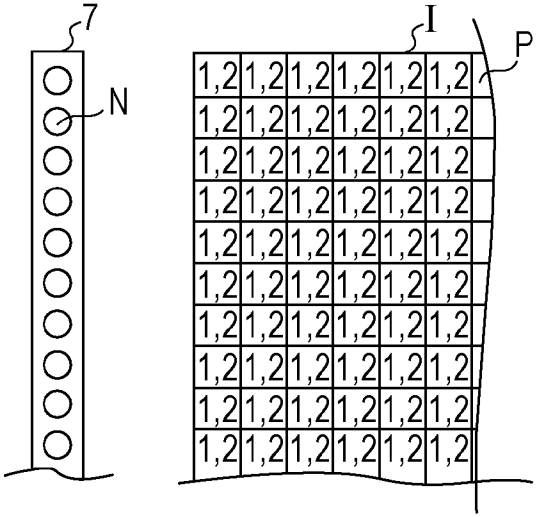

FIGS. 3A, 3B, and 3C are schematic diagrams which represent the discharge positions of the ink during recording onto the recording media M using the recording apparatus 1 of the present embodiment.

In addition, FIG. 3A, FIG. 3B, and FIG. 3C are diagrams which correspond to three types of recording mode of the recording apparatus 1 of the present embodiment and show whether, and at what rotation number of the rotating body 3, ink is discharged for each of pixels P of a recorded image I which is formed by discharging ink from the recording head 7 onto the recording media M.

In FIG. 3A, FIG. 3B, and FIG. 3C, the numbers given in each of the pixels P show whether, and at what rotation number of the rotating body 3, ink is discharged, 1 indicating the first rotation and 2 indicating the second rotation.

Here, in the recorded images I in FIG. 3A, FIG. 3B, and FIG. 3C, the vertical direction corresponds to the direction in which nozzles N of the recording head 7 are lined up and the horizontal direction corresponds to the rotation direction A of the rotating body 3.

In the recording mode which carries out recording at the discharge positions of the ink represented in FIG. 3A, one row is recorded in the vertical direction for each rotation of the rotating body 3. In detail, the odd numbered rows such as the first row or the third row in the vertical direction are recorded in the first rotation and the even numbered rows such as the second row or the fourth row in the vertical direction are recorded in the second rotation. Accordingly, ink is not discharged onto pixels P which are adjacent in the horizontal direction in the same rotation of the rotating body 3. By carrying out recording in such a recording mode, it is possible to slow the driving timing of the recording head 7 compared to a case of carrying out recording continuously onto the pixels P in the horizontal direction, and it is possible to stabilize the menisci of the nozzles N and to discharge the ink in a stable manner.

In the recording mode for recording at the discharge positions of the ink represented in FIG. 3B, the ink is not discharged onto adjacent pixels P in the vertical direction and the horizontal direction in the same rotation of the rotating body 3. For this reason, it is possible to suppress a decrease in the quality of the recorded image due to the dot shapes of the ink formed on the recording media M being lost by the ink on adjacent pixels P sticking together before drying.

In addition, by carrying out recording in this recording mode, it is possible to slow the driving timing of the recording head 7 compared to a case of carrying out recording continuously onto the pixels P in the horizontal direction and it is possible to discharge the ink in a stable manner in the same manner as the recording mode for carrying out recording at the discharge positions of the ink represented in FIG. 3A.

In addition, in the recording modes for carrying out recording at discharge positions of the ink represented by FIG. 3A and FIG. 3B, the drying is easier since the plurality of ink dots formed on the recording media M are respectively formed at intervals.

In the recording mode for carrying out recording at the discharge positions of the ink represented in FIG. 3C, ink is discharged to be overlapped a plurality of times at the same position on the recording media M by rotating the rotating body 3.

For this reason, recording is carried out by overlapping ink on the recording media M by dividing the recording into a plurality of times by rotating the rotating body 3. It is possible to carry out recording so as to achieve a desired state by increasing the density of the ink by discharging the same type of ink to be overlapped or by improving the adhesion, changing the visibility and the tint, or the like by discharging different types of ink to be overlapped, or the like.

Here, the recording modes are not limited to the three described above. Ink may be discharged to the pixels P every plurality of rotations of the rotating body 3. In a case where ink is discharged every plurality of rotations, it allows the ink to take longer to dry. In a case where it is desirable to allow a long time for the drying, it is possible to set the rotation time of one period and adjust the rotating speed to match the drying time.

Embodiment 2

FIG. 4

Next, detailed description will be given of a recording apparatus of Embodiment 2 with reference to the accompanying diagrams.

Figure 4:
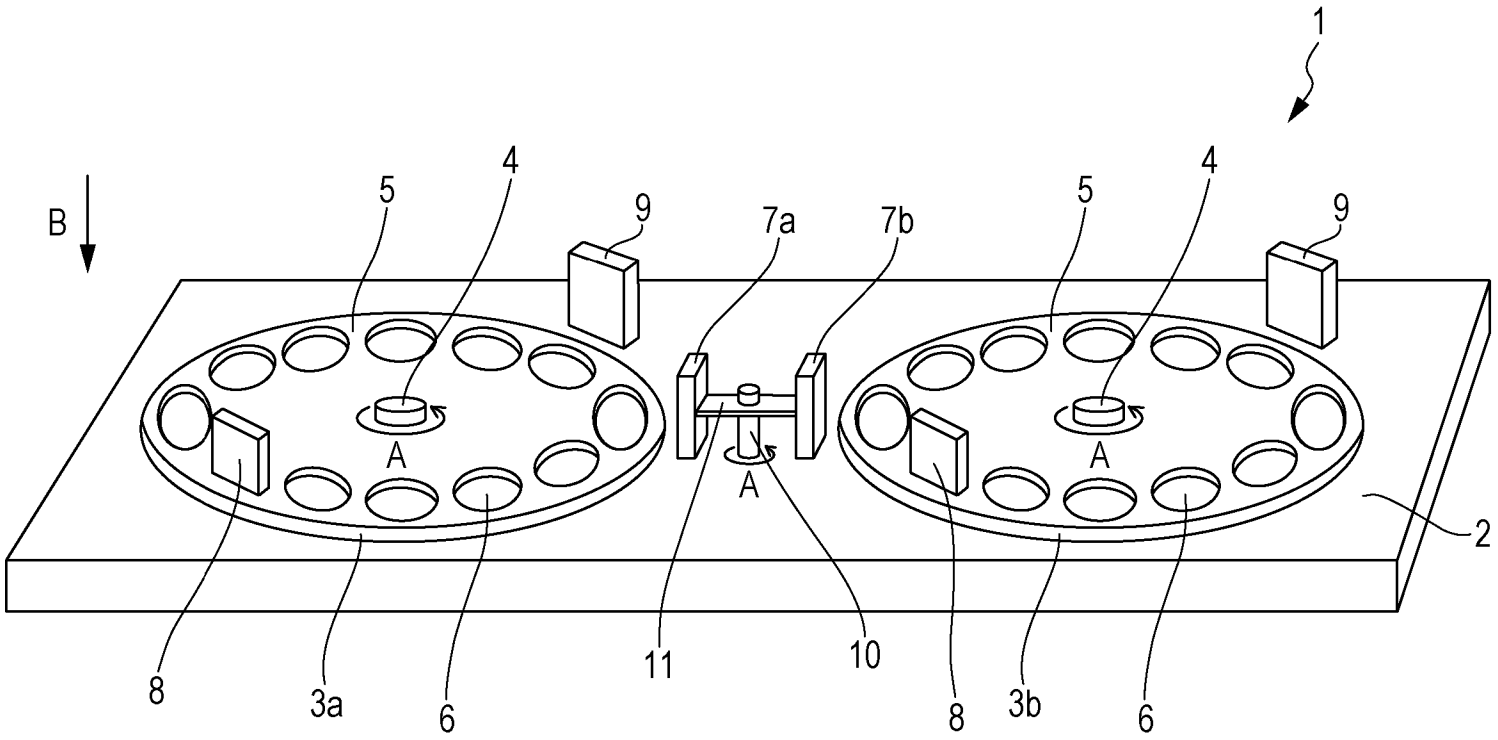
FIG. 4 is a schematic perspective diagram which represents a recording apparatus according to Embodiment 2 of the present invention.

FIG. 4 is a schematic perspective diagram which represents the recording apparatus 1 of the present embodiment. Here, the constituent members which are common to the embodiment described above are illustrated with the same reference numerals and detailed description thereof will be omitted.

Here, the recording apparatus 1 of the present embodiment has a configuration provided with a plurality of rotating bodies and recording heads. In detail, the recording apparatus 1 of the present embodiment is provided with a first rotating body 3*a* and a second rotating body 3*b*, and a first recording head 7*a* and a second recording head 7*b*.

The recording apparatus 1 of the present embodiment has the first recording head 7*a* which discharges white ink which forms a base layer, and the second recording head 7*b* which discharges color inks formed of black, cyan, magenta, and yellow which form a recorded image on the base layer. Then, the first recording head 7*a* and the second recording head 7*b* are configured to be able to move 180° by being connected with a rotation support section 11, which has a direction switching shaft 10, and rotating in the rotation direction A with the direction switching shaft 10 as a reference. Then, for the first recording head 7*a* and the second recording head 7*b*, it is possible to discharge ink onto the recording media M which are supported on the first rotating body 3*a* at the position of the first recording head 7*a* in FIG. 4, and it is possible to discharge ink onto the recording media M which are supported on the second rotating body 3*b* at the position of the second recording head 7*b* in FIG. 4.

That is, the first recording head 7*a* and the second recording head 7*b* are common to the first rotating body 3*a* and the second rotating body 3*b*.

Here, the recording apparatus 1 of the present embodiment has a configuration which has a recording head which discharges white ink which forms a base layer as the first recording head 7*a* and which has a recording head which discharges color inks which form a recorded image as the second recording head 7*b*. However, without being limited to such a configuration, for example, the recording apparatus 1 may have a configuration where the first recording head 7*a* and the second recording head 7*b* are both set as recording heads which discharge color inks which form recorded images. In addition, the inks are not limited to the above description and it is possible to use, other than the color inks described above, clear ink which does not include a coloring material, a treatment liquid which improves the adhesion of the components which are included in the ink, a reaction liquid which reacts with the recording media, the ink which is attached to the recording media, or the like. In addition, although ink which is dried by heating or the like is used in the present embodiment, the ink may be ink which is cured by light such as ultraviolet rays or heat, or the like. In addition, resin or the like may be included in the ink. In addition, there may be a configuration where it is possible to discharge a plurality of types of ink from one recording head or there may be a configuration where it is possible to discharge only one type of ink from one recording head.

In this manner, the recording apparatus 1 of the present embodiment has a configuration which is provided with a plurality of rotating bodies (the first rotating body 3*a* and the second rotating body 3*b*), and where the recording head 7*a* and the recording head 7*b* are common to the rotating body 3*a* and the rotating body 3*b*.

Since a plurality of rotating bodies are provided, the recording apparatus 1 of the present embodiment has a configuration where it is possible to shorten the time for recording onto a plurality of recording media M compared to the recording apparatus of Embodiment 1.

In addition, since the recording heads are common to the plurality of rotating bodies, the recording apparatus 1 of the present embodiment has a configuration where it is possible to reduce the costs and to increase the use efficiency of the recording heads.

In addition, the recording apparatus 1 of the present embodiment is provided with a plurality of recording heads which correspond to the plurality of rotating bodies. Then, the recording apparatus 1 is configured to carry out recording with the second recording head 7*b* out of the plurality of recording heads onto the recording media M which are supported on the second rotating body 3*b* out of the plurality of rotating bodies while recording with the first recording head 7*a* out of the plurality of recording heads onto the recording media M which are supported on the first rotating body 3*a* out of the plurality of rotating bodies.

For this reason, the present embodiment has a configuration where it is possible to increase the use efficiency of the recording heads.

In addition, the recording apparatus 1 of the present embodiment has the rotation support section 11 which supports the first recording head 7*a* and the second recording head 7*b*. Then, by rotating the rotation support section 11 180° in the rotation direction A, it is possible to move the first recording head 7*a* and the second recording head 7*b* from the positions which are represented in FIG. 4 where the recording media M which are supported on the first rotating body 3*a* and the first recording head 7*a* are opposed and where the recording media M which are supported on the second rotating body 3*b* and the second recording head 7*b* are opposed to the positions where the recording media M which are supported on the first rotating body 3*a* and the second recording head 7*b* are opposed and where the recording media M which are supported on the second rotating body 3*b* and the first recording head 7*a* are opposed.

For this reason, it is possible to increase the use efficiency of the recording head with a simple configuration.

Here, the recording apparatus 1 of the present embodiment has a configuration where the positions of the first recording head 7*a* and the second recording head 7*b* are switched by rotating the rotation support section 11 180° in the rotation direction A; however, the recording apparatus 1 is not limited to this configuration. There may be a configuration which has a mechanism where it is possible for each of the first recording head 7*a* and the second recording head 7*b* to rotate, it is possible to change the orientation to the first rotating body 3*a* direction and the second rotating body 3*b* direction, and it is possible to move between the first rotating body 3*a* and the second rotating body 3*b*, and where the first recording head 7*a* and the second recording head 7*b* are each able to oppose the first rotating body 3*a* or the second rotating body 3*b* according to necessity.

Here, the recording apparatus 1 of the present embodiment has a configuration which has two of each of the rotating bodies and the recording heads; however, the configuration may have three or more of each. In addition, the numbers of the rotating bodies and the recording heads may be different. For example, the recording apparatus 1 may have a configuration where the number of recording heads is smaller than the number of rotating bodies and the recording media are removed and supplied while the rotation is stopped by pausing the recording onto the recording media on a certain rotating body, in which the number of recording heads is sufficient to perform recording with respect to the recording media placed on the other rotating bodies which are rotated in order to carry out recording. In such a case, there are no or few recording heads which are paused and the use efficiency of the recording heads is increased. For this reason, since periods where the ink is not discharged from the recording heads are reduced and it is difficult for nozzle clogging to occur, it is possible to suppress wasteful discharge during a paused period, and it is easy to maintain the recording heads in a favorable state.

In addition, there may be a configuration where the number of recording heads is greater than the number of rotating bodies and a plurality of recording heads are arranged at the periphery of the rotating bodies. In such a case, there may be a configuration which has a plurality of recording heads and only one rotating body. In addition, there may be a configuration where a plurality of recording heads are arranged at the periphery of the rotating bodies, and the recording heads of one part are common between other rotating bodies. With a configuration where a plurality of recording heads are arranged at the periphery of the rotating bodies, it is possible to efficiently perform recording and it is possible to shorten the time for recording. In such a case, with a configuration where a plurality of recording heads which are arranged at the periphery of the rotating bodies each discharge the same type of ink, errors are diffused due to the number of nozzles being used increasing and it is difficult to distinguish unevenness. In addition, with a configuration where each of a plurality of recording heads which are arranged on the periphery of the rotating bodies discharges different types of ink, it is possible to discharge numerous types of ink, it is possible to complete the recording on one rotating body, and it is possible to execute various types of recording with respect to the recording media even when the types of ink which are able to be discharged from one recording head are limited.

The entire disclosure of Japanese Patent Application No. 2013-239667, filed Nov. 20, 2013 is expressly incorporated by reference herein.

What is claimed is:

1. A recording apparatus comprising:

a rotating body which supports a three-dimensional recording medium on a support surface in a direction which intersects with a gravity direction and has a rotating shaft in a direction which intersects with the support surface, wherein the rotating body is able to support a plurality of the recording medium concurrently on the support surface of the rotating body during recording; and a recording head which carries out recording onto the recording medium by discharging ink in a direction which intersects with the rotating shaft, the recording apparatus further comprising a plurality of the rotating bodies, wherein the recording head is common to the plurality of rotating bodies.

2. The recording apparatus according to claim 1, wherein the recording medium is a container which is able to change shape.

3. The recording apparatus according to claim 1, wherein a plurality of the recording heads are provided, and the recording medium which are supported on each of the rotating bodies and each of the recording heads are able to oppose each other.

4. The recording apparatus according to claim 3, further comprising:

a rotation support section which supports the plurality of recording heads, wherein, by rotating the rotation support section, it is possible to change a combination of the rotating body on which the recording medium are supported and the recording head.

5. The recording apparatus according to claim 1, wherein the rotating body rotates in one direction and it is possible to discharge ink a plurality of times with respect to the same recording medium.

6. The recording apparatus according to claim 1, further comprising:

a maintenance box that is disposed on the support surface, wherein the maintenance box is able to oppose the recording head by the rotating the rotating body.

* * * * *